United States Patent [19]

Trytten

[11] 4,243,015

[45] Jan. 6, 1981

[54] ASH-FREE FIREPLACE VENTILATING APPARATUS

[76] Inventor: Glaydon C. Trytten, R.R. 2, Lake Mills, Iowa 50450

[21] Appl. No.: 970,614

[22] Filed: Dec. 18, 1978

[51] Int. Cl.[3] ..... F24B 1/18; F24B 7/00

[52] U.S. Cl. ..... 126/120; 126/121

[58] Field of Search ..... 126/120, 121, 285

[56] References Cited

U.S. PATENT DOCUMENTS

| | | | |
|---|---|---|---|
| 190,950 | 5/1877 | Blake | 126/285 A |
| 230,389 | 7/1880 | Adair | 126/120 |
| 1,065,839 | 6/1913 | Ritzman | 126/285 A |
| 2,322,016 | 6/1943 | Hardeman | 126/121 |
| 4,061,127 | 12/1977 | Fisher | 126/120 |

*Primary Examiner*—Samuel Scott
*Assistant Examiner*—Wesley S. Ratliff, Jr.
*Attorney, Agent, or Firm*—Zarley, McKee, Thomte, Voorhees & Sease

[57] ABSTRACT

An ash-free ventilating apparatus for use in a fireplace is disclosed comprising a grate element adapted to detachably secure to the opposing end walls of a fireplace and extend therebetween, a ventilator housing centrally located within the fireplace and below the grate element and having an inlet port for connection to a source of fresh air and outlet ports in fluid communication with the inlet port, and a valve operationally connected to the outlet ports to regulate the flow of fresh air through the outlet ports. The ventilator housing has two elongated side walls with each side wall sloping downwardly and outwardly toward the immediately adjacent fireplace end wall to guide the fallen ash matter to an ash pit. An additional deflecting wall is disposed adjacent each end wall of the fireplace and opposite to the elongated side walls of the ventilator housing to also deflect fallen ash matter to the ash pit. The valve is comprised of a plate element slidably mounted to the top portion of the ventilator housing to selectively open and close the outlet ports to control the air flow therethrough. A cover is attached above the plate element to prevent blockage of the valve and outlet ports.

20 Claims, 7 Drawing Figures

ASH-FREE FIREPLACE VENTILATING APPARATUS

BACKGROUND OF THE INVENTION

This invention relates to a ventilating apparatus for fireplaces, and more particularly to an ash-free ventilating apparatus. While prior fireplace structures, such as that disclosed in the patent to Ashman Jr. U.S. Pat. No. 3,976,048, utilized fresh outside air exclusively for combustion within the fireplace, the prior devices did not provide for central distribution across the center of the grate and did not allow for manual control of the flow rate of outside air. Also, the prior devices were not ash-free and did not guide the fallen ash matter to an ash pit or accumulation receptacle.

SUMMARY OF THE INVENTION

An ash-free ventilating apparatus for use in a fireplace is disclosed comprising a grate element adapted to support a wood grate and extending between the end walls of a fireplace and being detachably secured thereto, a ventilator housing centrally located below the grate and having an inlet port adapted for connection to a source of fresh outside air and a plurality of outlet ports in communication with the inlet port and disosed below the center of the grate, and a valve operationally connected to the outlet ports to regulate the flow of fresh air out of the outlet ports. The ventilator housing has elongated side walls sloping downwardly from the grate and outwardly toward the fireplace end walls to guide fallen ash matter to an ash pit or accumulation area. A pair of additional elongated deflector walls are mounted to the opposing end walls of the fireplace and slope downwardly and inwardly from the end walls toward the ash pit to guide fallen ash matter to the ash pit. A cover plate extends over the valve and outlet ports to prevent blockage thereof by fallen ash matter.

It is a principal object of this invention to provide an improved fireplace ventilating apparatus.

A further object of the invention is to provide a fireplace ventilating apparatus that is ash-free.

A still further object of the invention is to provide a fireplace ventilating apparatus that distributes outside fresh air across the center portion of a grate.

A still further object of the invention is to provide a fireplace ventilating apparatus that allows regulation of the flow of outside fresh air to the center portion of a grate.

A still further object of the invention is to provide a fireplace ventilating apparatus that guides fallen ashes to an ash receptacle or ash pit.

A still further object of the invention is to provide an ash-free fireplace ventilating apparatus having a detachably mounted grate.

A still further object of the invention is to provide an ash-free fireplace ventilating apparatus having sloping side walls to guide falling ash to an ash pit or ash receptacle.

A still further object of the invention is to provide a fireplace ventilating apparatus having a cover element to prevent blockage of the fresh air discharge ports and regulating valves.

A still further object of the invention is to provide an ash-free fireplace ventilating apparatus that is economical to manufacture, durable in use and refined in appearance.

DESCRIPTION OF THE PREFERRED EMBODIMENT

Figure 1:
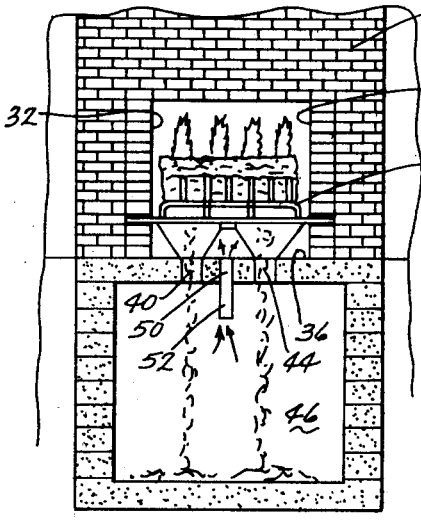
FIG. 1 is an elevated front view of the invention mounted in a conventional fireplace.

The ash-free fireplace ventilating apparatus of this invention is generally designated by the numeral 10 and is shown mounted in a conventional fireplace 12 in FIG. 1.

Ventilating apparatus 10 is generally comprised of ventilator housing 14, valve 16 and grate assembly 18.

Figure 2:
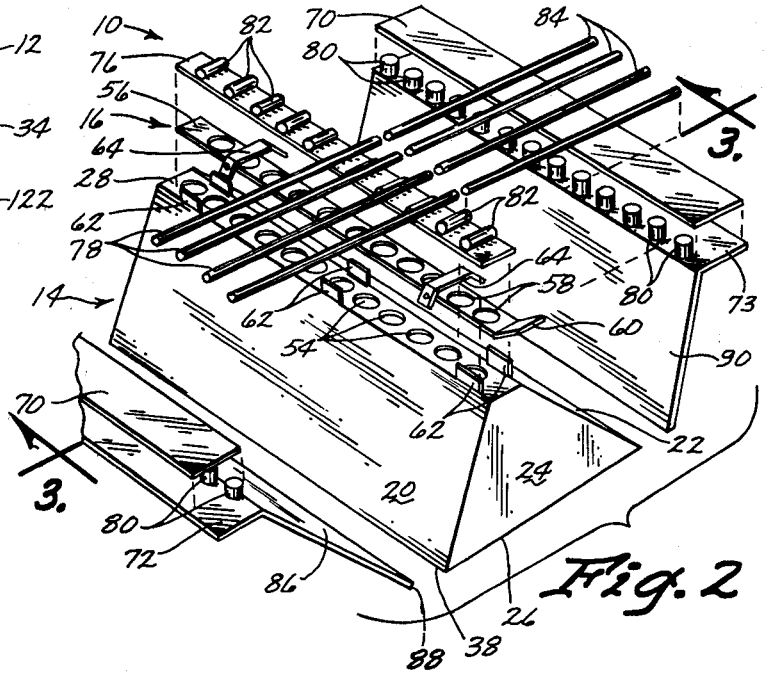
FIG. 2 is a partially exploded perspective view of the invention.
Figure 3:
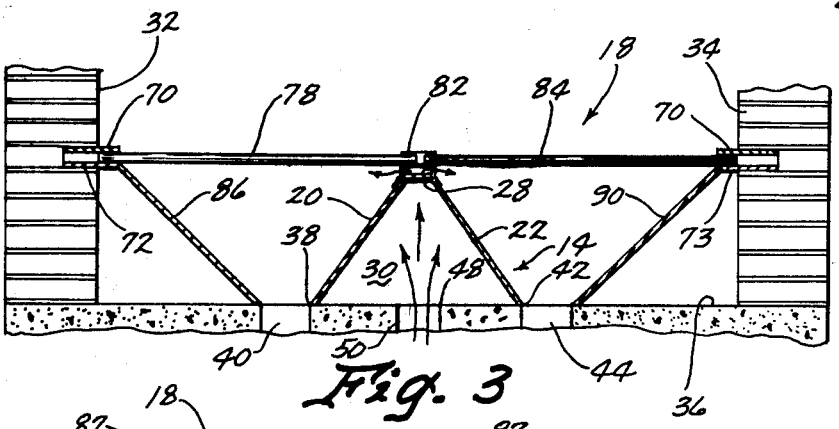
FIG. 3 is a sectional view seen on line 3—3 of FIG. 2.

Ventilator housing 14 has a pair of elongated opposing side walls 20 and 22, end walls 24, bottom 26 and apex portion 28 (FIG. 2) forming an enclosed chamber 30. Housing 14 is adapted to be centrally disposed between end walls 32 and 34 of fireplace 12. Side wall 20 slopes downwardly from apex portion 28 and outwardly toward end wall 32 as shown in FIG. 3. Side wall 22 slopes downwardly from apex portion 28 and outwardly toward end wall 34. Housing 14 is supported on hearth surface 36 with the lower edge 38 of side wall 20 abutting hearth surface 36 adjacent ash pit passageway 40 and with the lower edge 42 of side wall 22 abutting hearth surface 36 adjacent ash pit passageway 44. As will be described in more detail subsequently, side walls 20 and 22 guide falling ash matter through passageways 40 and 42, respectively, into ash pit 46 as illustrated in FIG. 1.

Bottom 26 of housing 14 has an air inlet port 48 in communication with chamber 30. Air passageway 50 extends through hearth surface 36 and is in alignment with inlet port 48. A conduit 52 is connected at one end to passageway 50 and at the other end to a source of outside fresh air. It will be apparent that conduit 52 has fitted thereto a conduit which is not illustrated and which extends outside of ash pit 46 and the building in which fireplace 12 is installed but this feature would be well understood to those skilled in the art. Apex portion 28 contains a plurality of outlet port apertures 54 therethrough to chamber 30 (FIG. 2). Thus, fresh air enters chamber 30 by way of conduit 52, passageway 50 and inlet port 48, and exits chamber 30 by way of outlet port apertures 54 with valve 16 regulating the flow of air through apertures 54.

Figure 4:
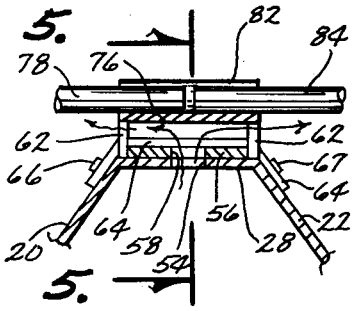
FIG. 4 is an enlarged sectional view of the valve portion of the present invention.
Figure 5:
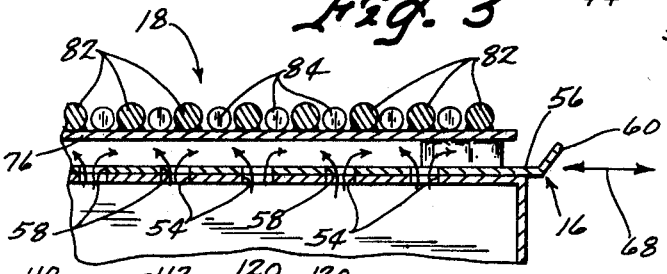
FIG. 5 is a partial sectional view seen on line 5—5 of FIG. 4.

Valve 16 is comprised of an elongated plate element 56 having a plurality of valve apertures 58 and a valve handle 60 attached thereto (FIGS. 2 and 5). Valve 16 is slidably mounted to housing 14 with plate element 56 in sliding contact with apex portion 28. Plate 56 is positioned between opposing pairs of standing posts 62 attached to apex portion 28. A pair of slide guides 64 slidably mount valve 16 to housing 14. As shown in FIG. 4, each slide guide 64 extends over plate element 56 and is attached at one end to side wall 20 by fastener 66 and is attached at the other end to said wall 22 by similar fastener 67. Slide guides 64 allow a sliding movement of valve 16 along apex surface 28 as indicated by arrow 68 in FIG. 5, but maintain plate 56 in abutting contacting relation with portion 28. Thus, the amount of air flowing out of apertures 54 can be controlled by the relative degree of alignment of apertures 58 with apertures 54. To allow maximum air flow, apertures 58 are in direct alignment with apertures 54 as shown in FIG. 5. Sliding plate 56 such that apertures 58 are laterally offset from apertures 54 will shut off the air flow since plate element 56 will be covering apertures 54. Between these two extremes, the air flow can be regulated by the relative degree of alignment between apertures 54 and 58.

Mounted within end wall 32 are a pair of spaced apart horizontal plates 70 and 72. In generally horizontal alignment with plate 72 is plate 76 connected to apex portion 28. Plates 70 and 72 slidably receive one end of bar element 78 and plate 76 supports the other end of bar element 78 (FIG. 3). Divider posts 80 attached to plate 72 and divider rods 82 attached to plate 76 maintain the plurality of bar elements 78 in parallel alignment (FIG. 2). Thus, bar elements 78 are detachably mounted to end wall 32 and housing 14 in horizontal, parallel alignment to form the grate. In a likewise manner, bar elements 84 are detachably mounted to end wall 34 by horizontal plates 71, 73. Plate 76 is secured to upstanding posts 62 by welding or the like (FIG. 4) and divider rods 82 are secured to plate 76 by welding or the like (FIG. 5). While two separate bar elements 78, 84 are shown, a single bar element extending between end wall 32 and end wall 34 will produce similar results and can be detachably mounted in the same way. A single bar element does not require support from housing 14.

Elongated deflecting plate 86 is connected at one end to plate 72 and slopes downwardly and inwardly away from end wall 32 as shown in FIG. 3. The lower edge 88 of deflecting plate 86 abuts hearth surface 36 adjacent passageway 40. In a similar manner, deflecting plate 90 is attached to plate 73 and extends downwardly and inwardly away from end wall 34 to abut hearth surface 36 adjacent passageway 44. Sidewalls 20, 22 and deflecting plates 86, 90 thus combine to guide falling ash matter through passageways 40, 44 into pit 46, as illustrated in FIG. 1. In this respect, ventilating apparatus 10 is an ash-free device in that the ashes are automatically removed from the fireplace.

Figure 6:
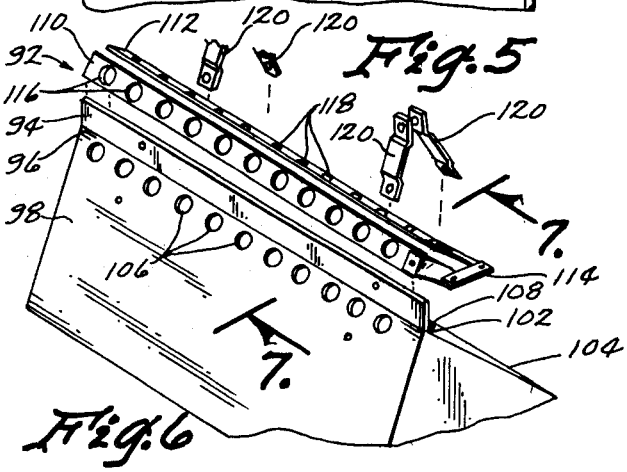
FIG. 6 is a partially exploded perspective view of an alternate embodiment of this invention.
Figure 7:
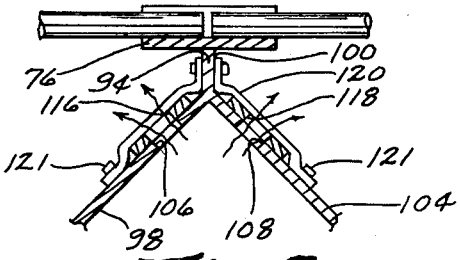
FIG. 7 is an enlarged sectional view seen on line 7—7 of FIG. 6.

An alternate valve 92 is shown in FIG. 6. In this alternate embodiment, flange 94 is connected to the upper edge 96 of side wall 98 and flange 100 is attached to the upper edge 102 of side wall 104. Flange 94 abuts flange 100 as shown in FIG. 7 so that side walls 98 and 104 form an inverted V-shaped housing similar to housing 14. A plurality of outlet port apertures 106 are located adjacent the upper edge 96 of side wall 98. Identically, a plurality of outlet port apertures 108 are located adjacent the upper edge 102 of side wall 104. Valve 92 comprises elongated plate elements 110 and 112 interconnected by handle 114 as shown in FIG. 6. Plate element 110 contains a plurality of valve apertures 116 intended for alignment with outlet apertures 106 and plate element 112 contains a plurality of valve apertures 118 intended for alignment with outlet apertures 108. Plates 110 and 112 are slidably mounted to side walls 98 and 104, respectively, by guides 120 so that valve apertures 116, 118 can be slidably moved into alignment or misalignment with outlet apertures 106, 108 to regulate the air flow in the same manner as valve 16. Guides 120 are attached to side walls 98, 104 by fasteners 121.

In operation, wood grate 122 is supported upon grate assembly 18 as shown in FIG. 1. Outside air is introduced into the fireplace to support combustion via conduit 52, passageway 50, and ventilator housing 14 so that the room air is not utilized to support combustion. Translucent doors or screens (not shown) could be mounted across the fireplace to prevent room air from entering the combustion space. The amount of air introduced into the combustion space is selectively regulated as desired by valve 16. The fresh air is evenly distributed across the center of the grate and exits laterally from both sides of apex portion 28 as illustrated by the air flow arrows in FIG. 4. This provides an even distribution across the center of the grate. The alternate valve 92 also provides selective regulation of air flow and distributes the air from both sides of the ventilator housing as illustrated by the flow arrows in FIG. 7 to provide an even distribution of air across the center of the grate.

As the wood burns and ashes are formed, the ashes descend and are deflected by side walls 20, 22 and deflecting plates 86, 90 into ash pit 46. In this respect, ventilating apparatus 10 is ash-free and cleaning is not necessary to remove the ashes. Plate 76 located atop valve 16 prevents the ashes from clogging the valve apertures 58 and the outlet apertures 54 of housing 14. In the embodiment of FIG. 1, the deflecting panels 86, 90 cooperate with side walls 20, 22 to restrict the ash drop opening to passageways 40 and 44 where the furnace 12 is equipped with an ash pit 46. However, in fireplaces where an ash pit is not provided, the device may be utilized without deflecting plates 86, 90 so that the hearth surface is utilized as an ash collecting surface or an ash receptacle may be placed thereon. Side walls 20 and 22 deflect fallen ash matter to the ash receptacles. In this environment of use, the detachably mounting of grate assembly 18 allows for easy access to the ash receptacle to facilitate removal of the accumulated ash matter. Thus, ventilator apparatus 10 can be used in fireplaces with and without an ash pit.

Thus, it can be seen that this device accomplishes at least all of its stated objectives.

What is claimed is:

1. In combination with a fireplace having a rear wall, oppositing first and second end walls, a hearth surface and a wood grate, an ash-free ventilating apparatus comprising, a grate means adapted to support said wood grate above said hearth surface, a ventilator housing supported on said hearth surface and located below said grate means, said housing being centrally located within said fireplace and having an interior chamber, inlet port means in communication with said chamber and adapted for connection to a source of fresh air, and outlet port means in communication with said chamber and centrally disposed below said grate means, valve means operationally connected to said outlet port means to regulate the flow of fresh air through said outlet port means, said ventilator housing comprising first and second elongated side walls and forward and rearward ends, each said side wall being in spaced apart relation to the immediately adjacent end wall of said fireplace and sloping downwardly toward said hearth surface and outwardly toward said immediately adjacent end wall so that said ventilator housing has a generally inverted V-shaped cross sectional area with the apex portion of said V-shape being centrally disposed between said end walls, said outlet port means comprising a plurality of outlet apertures positioned along said apex portion and extending therethrough, and said valve means comprising a plate element slidably mounted to said apex portion, said plate element having a plurality of valve apertures therethrough to alternatively, selectively align and misalign with said outlet apertures.

2. The combination of claim 1 wherein a cover element is mounted to said apex portion above said plate element, said cover element being in spaced apart relation to said plate element.

3. An ash-free ventilating apparatus comprising, a grate means adapted for securement between the end walls of a fireplace, a ventilator housing operationally connected to said grate means, said housing being centrally located below said grate means and having an interior chamber, and adapted for connection to a source of fresh air, and outlet port means in communication with said chamber, and valve means operationally connected to said outlet port means to regulate the flow of fresh air through said outlet port means; wherein said ventilator housing comprises, first and second elongated side walls and forward and rearward ends, each said side wall sloping downwardly and outwardly from the center portion of said grate means so that said ventilator housing has a generally inverted V-shaped cross sectional area with the apex portion of said V-shape being centrally disposed below said grate means; wherein said valve means is operationally attached to said apex portion.

4. The device of claim 3 wherein, said outlet port means comprises a plurality of outlet apertures positioned along said apex portion and extending therethrough, and said valve means comprises a plate element slidably mounted to said apex portion, said plate element having a plurality of valve apertures therethrough to alternatively, selectively align and misalign with said outlet apertures.

5. The device of claim 4 wherein a cover element is mounted to said apex portion above said plate element, said cover element being in spaced apart relation to said plate element.

6. The device of claim 3 wherein, said outlet port means comprises a plurality of first outlet apertures through said first side wall and located adjacent said apex portion, and a plurality of second outlet apertures through said second side wall and located adjacent said apex portion, and said valve means comprises a first plate element slidably mounted to said first side wall, said first plate element having a plurality of valve apertures therethrough to alternatively, selectively align and misalign with said first outlet apertures of said first side wall, and a second plate element slidably mounted to said second side wall, said second plate element having a plurality of valve apertures therethrough to alternatively, selectively, align and misalign with said second outlet apertures of said second side wall.

7. The device of claim 3 wherein a third elongated side wall is adapted for mounting adjacent one end wall of a fireplace so that said third elongated side wall extends downwardly and inwardly from said one end wall toward said ventilating housing, and a fourth elongaged side wall is adapted for mounting adjacent the other end wall of a fireplace so that said fourth elongated side wall extends downwardly and inwardly from said other end wall toward said ventilator housing.

8. The device of claim 3 wherein said grate means comprises a plurality of parallel bar elements, each said bar element adapted for extension between the end walls of a fireplace and detachable securement thereto.

9. The device of claim 3 wherein said grate means comprises, a plurality of first bar elements in parallel horizontal alignment, said first bar elements being detachably secured at one end to said apex portion and adapted at said other end for detachable securement to one end wall of a fireplace for extension between said one end wall and said apex portion, and a plurality of second bar elements in parallel horizontal alignment, said second bar elements being detachably secured at one end to said apex portion and adapted at said other end for detachable securement to the other end wall of a fireplace for extension between said other end wall and said apex portion.

10. In combination with a fireplace having a rear wall, opposing first and second end walls, a hearth surface and a wood grate, a grate means adapted to support said wood grate above said hearth surface, a housing supported on said hearth surface and located below said grate means, said housing being centrally located within said fireplace, said housing comprising, first and second elongated side walls and forward and rearward ends, each said wall being in spaced apart relation to the immediately adjacent end wall of said fireplace and sloping downwardly toward said hearth surface and outwardly toward said immediately adjacent end wall so that said housing has a generally inverted V-shaped cross sectional area with the apex portion of said V-shape being centrally disposed between said end walls, an ash pit below said hearth surface and first and second passageways through said hearth surface to said ash pit with said first side wall of said housing terminating adjacent said first passageway and adapted to guide falling ashes into said first passageway and said second side wall of said housing terminating adjacent said second passageway and adapted to guide falling ashes into said second passageway.

11. The combination of claim 10 wherein a third elongated side wall is mounted adjacent said first end wall of said fireplace so that said third elongated side wall extends downwardly and inwardly from said first end wall to said first passageway, and a fourth elongated side wall is mounted adjacent said second end wall of said fireplace so that said fourth elongated side wall extends downwardly and inwardly from said second end wall to said second passageway.

12. The combination of claim 10 wherein said grate means comprises a plurality of parallel bar elements, each said bar element extending between said end walls of said fireplace and being detachably secured to said end walls.

13. The combination of claim 10 wherein said grate means comprises a plurality of first bar elements in a parallel horizontal alignment, each said first bar element extending between said first end wall and said apex portion and being detachably secured to said first end wall and said apex portion, and a plurality of second bar elements in parallel horizontal alignment, each said second bar element extending between said second end wall and said apex portion and being detachably secured to said second end wall and said apex portion.

14. The combination of claim 10 wherein, said first bar elements have first and second ends with said first end wall having a first slot means attached thereto, said first slot means being adapted to slidably supportively receive said first ends of said first bar elements and said apex portion having a support means attached thereto, said support means adapted to supportively receive said second ends of said first bar elements, and said second bar elements have first and second ends with said second end wall having a third slot means attached thereto, said third slot means being adapted to slidably supportively receive said first ends of said second bar elements and said support means being adapted to supportively receive said second ends of said second bar elements.

15. The combination of claim 10 wherein said housing functions as a ventilator and includes an interior chamber, inlet port means in communication with said chamber and adapted for connection to a source of fresh air, and outlet port means in communication with said chamber and centrally disposed below said grate means.

16. The combination of claim 15 wherein a valve means is operationally connected to said outlet port means to regulate the flow of fresh air through said outlet port means.

17. In combination with a fireplace having a rear wall, opposing first and second end walls, a hearth surface and a wood grate, an ash-free ventilating apparatus comprising, a grate means adapted to support said wood grate above said hearth surface, a ventilator housing supported on said hearth surface and located below said grate means, said housing being centrally located within said fireplace and having an interior chamber, inlet port means in communication with said chamber and adapted for connection to a source of fresh air, and outlet port means in communication with said chamber and centrally disposed below said grate means, valve means operationally connected to said outlet port means to regulate the flow of fresh air through said outlet port means, said ventilator housing comprising first and second elongated side walls and forward and rearward ends, each said side wall being in spaced apart relation to the immediately adjacent end wall of said fireplace and sloping downwardly toward said hearth surface and outwardly toward said immediately adjacent end wall so that said ventilator housing has a generally inverted V-shaped cross sectional area with the apex portion of said V-shape being centrally disposed between said end walls, said outlet port means comprising a plurality of first outlet apertures through said first side wall and located adjacent said apex portion, and a plurality of second outlet apertures through said second side wall and located adjacent said apex portion, and said valve means comprising a first plate element slidably mounted to said first side wall, said first plate element having a plurality of valve apertures therethrough to alternatively, selectively align and misalign with said first outlet apertures of said first side wall, and a second plate element slidably mounted to said second side wall, said second plate element having a plurality of valve apertures therethrough to alternatively, selectively, align and misalign with said second outlet apertures of said second side wall.

18. In combination with a fireplace having a rear wall, opposing first and second end walls, a hearth surface and a wood grate, an ash-free ventilating apparatus comprising, a grate means adapted to support said wood grate above said hearth surface, a ventilator housing supported on said hearth surface and located below said grate means, said housing being centrally located within said fireplace and having an interior chamber, inlet port means in communication with said chamber and adapted for connection to a source of fresh air, and outlet port means in communication with said chamber and centrally disposed below said grate means, valve means operationally connected to said outlet port means to regulate the flow of fresh air through said outlet port means, said ventilator housing comprising first and second elongated side walls and forward and rearward ends, each said side wall being in spaced apart relation to the immediately adjacent end wall of said fireplace and sloping downwardly toward said hearth surface and outwardly toward said immediately adjacent end wall so that said ventilator housing has a generally inverted V-shaped cross sectional area with the apex portion of said V-shape being centrally disposed between said end walls, and said grate means comprising a plurality of parallel bar elements, each said bar element extending between said end walls of said fireplace and being detachably secured to said end walls.

19. In combination with a fireplace having a rear wall, opposing first and second end walls, a hearth surface and a wood grate, an ash-free ventilating apparatus comprising, a grate means adapted to support said wood grate above said hearth surface, a ventilator housing supported on said hearth surface and located below said grate means, said housing being centrally located within said fireplace and having an interior chamber, inlet port means in communication with said chamber and adapted for connection to a source of fresh air, and outlet port means in communication with said chamber and centrally disposed below said grate means, valve means operationally connected to said outlet port means to regulate the flow of fresh air through said outlet port means, said ventilator housing comprises first and second elongated side walls and forward and rearward ends, each said side wall being in spaced apart relation to the immediately adjacent end wall of said fireplace and sloping downwardly toward said hearth surface and outwardly toward said immediately adjacent end wall so that said ventilator housing has a generally inverted V-shaped cross sectional area with the apex portion of said V-shape being centrally disposed between said end walls, said grate means comprising a plurality of first bar elements in parallel horizontal alignment, each said first bar element extending between said first end wall and said apex portion and being detachably secured to said first end wall and said apex portion, and a plurality of second bar elements in parallel horizontal alignment, each said second bar element extending between said second end wall and said apex portion and being detachably secured to said second end wall and said apex portion.

20. The combination of claim 19 wherein, said first bar elements have first and second ends with said first end wall having a first slot means attached thereto, said first slot means being adapted to slidably supportively receive said first ends of said first bar elements and said apex portion having a support means attached thereto, said support means adapted to supportively receive said second ends of said first bar elements, and said second bar elements have first and second ends with said second end wall having a third slot means attached thereto, said third slot means being adapted to slidably supportively receive said first ends of said second bar elements and said support means being adapted to supportively receive said second ends of said second bar elements.

* * * * *